US009539488B2

(12) United States Patent
Schenck et al.

(10) Patent No.: US 9,539,488 B2
(45) Date of Patent: Jan. 10, 2017

(54) SNOWSPORT APPARATUS WITH NON-NEWTONIAN MATERIALS

(71) Applicant: Renoun LLC, Shelburne, VT (US)

(72) Inventors: Cyrus Schenck, Shelburne, VT (US); Cameron Jones, Lake George, NY (US); Gregory Bright, Potsdam, NY (US)

( * ) Notice: Subject to any disclaimer, the term of this patent is extended or adjusted under 35 U.S.C. 154(b) by 0 days.

(21) Appl. No.: 14/443,142

(22) PCT Filed: Nov. 26, 2013

(86) PCT No.: PCT/US2013/071851
§ 371 (c)(1),
(2) Date: May 15, 2015

(87) PCT Pub. No.: WO2014/082058
PCT Pub. Date: May 30, 2014

(65) Prior Publication Data

US 2015/0335985 A1 Nov. 26, 2015

Related U.S. Application Data

(60) Provisional application No. 61/729,771, filed on Nov. 26, 2012.

(51) Int. Cl.
*A63C 5/12* (2006.01)
*A63C 5/03* (2006.01)
*A63C 5/056* (2006.01)

(52) U.S. Cl.
CPC ..... *A63C 5/122* (2013.01); *A63C 5/03* (2013.01); *A63C 5/126* (2013.01); *A63C 5/056* (2013.01); *A63C 5/124* (2013.01); *Y10T 156/10* (2015.01)

(58) Field of Classification Search
CPC ..... A63C 5/122; A63C 5/126; A63C 5/12; A63C 5/124; A63C 5/056
See application file for complete search history.

(56) References Cited

U.S. PATENT DOCUMENTS 4,175,767 A 11/1979 Scheruebl
5,005,853 A * 4/1991 Lampl ..... A63C 5/126 280/610

(Continued)

FOREIGN PATENT DOCUMENTS

WO WO/2009/063332 5/2009

OTHER PUBLICATIONS

U.S. Appl. No. 13/332,162, filed Apr. 19, 2012, Lammer.
U.S. Appl. No. 13/972,648, filed Mar. 20, 2014, Lammer.

*Primary Examiner* — Erez Gurari
(74) *Attorney, Agent, or Firm* — Keegan Caldwell

(57) ABSTRACT

A design for snowsports devices such as skis and snowboards uses non-Newtonian materials. Non-Newtonian materials exhibit rate-sensitive characteristics, with stress vs. strain properties dependent on the rate of loading. The snowsports device with non-Newtonian materials has variable stiffness and damping, with both increasing according to an increased applied load-rate such that a single snowsports device exhibits soft flex characteristics under low applied load-rates, but stiffer flex characteristics under high applied load-rates. The flex of the snowsports device is self-adjusting, with no manual adjustment input required by a user. The non-Newtonian material may be incorporated into the structure of the snowsports device in a number of different ways, including in the core, in composite sheet layers, and other locations.

18 Claims, 6 Drawing Sheets

(56) References Cited

U.S. PATENT DOCUMENTS

| | | | | |
|---|---|---|---|---|
| 5,035,442 | A | 7/1991 | Arnsteiner | |
| 5,186,777 | A * | 2/1993 | Perenon | A63C 5/12 156/245 |
| 5,217,243 | A * | 6/1993 | Recher | A63C 5/12 280/610 |
| 5,238,260 | A * | 8/1993 | Scherubl | A63C 5/04 280/610 |
| 5,759,664 | A * | 6/1998 | Chisnell | A63C 5/12 280/610 |
| 5,803,478 | A | 9/1998 | Gavalis | |
| 6,059,307 | A * | 5/2000 | Western | A63C 5/124 280/609 |
| 6,502,849 | B1 * | 1/2003 | Kamiakito | A63C 5/12 280/608 |
| 6,520,529 | B1 * | 2/2003 | DeRocco | A63C 5/03 280/601 |
| 6,637,766 | B2 | 10/2003 | Cuzzit | |
| 7,246,568 | B1 * | 7/2007 | Cheung | A63C 5/03 114/357 |
| 8,105,184 | B2 | 1/2012 | Lammer | |
| 8,276,296 | B2 | 10/2012 | Frederick | |

* cited by examiner

SNOWSPORT APPARATUS WITH NON-NEWTONIAN MATERIALS

CROSS-REFERENCE TO RELATED APPLICATION

The application claims benefit of priority to U.S. provisional patent application No. 61/729.771, filed Nov. 26, 2012; and to PCT application PCT/US2013/071851, filed Nov. 26, 2013.

FEDERALLY-SPONSORED RESEARCH

None

BACKGROUND

Field of the Invention

The system described in this application relates to the field of snowsport devices, specifically skis and snowboards, hereinafter collectively referred to as skis for brevity. A major determinant of the performance of a ski is its damping characteristics and its stiffness, and/or flex, characteristics. This includes planar stiffness across the length of the ski, as well as torsional stiffness from tip to tail.

A ski can be considered in three sections: the tip, located at the front of the ski; the midsection, located around the binding; and the tail, located at the opposite end from the tip. Each section may be fabricated to produce the desired overall flex characteristics for the ski. For instance, skis for slalom competition, which requires short-radius turns on dense snow under high loads, are typically built with the highest stiffness characteristics, particularly at the tip and the tail. At the other end of the spectrum are skis built for powder snow, which are more flexible through their length, as the snow surface is soft with powder turns generally larger in radius.

The flex of each individual section of the ski—tip, midsection, and tail—is considered in the design and manufacturing of the ski/board. Modern skis are composed of a laminated structure, in which materials such as fiberglass, carbon fiber, polymer sheets, metals, nylon, wood, foam, and other materials known in the art are bonded together under pressure, typically with epoxy resin. By choosing different materials, different shapes and sizes of materials, and assembling such materials in different ways, the desired flex characteristics of a ski may be achieved.

Thus, in conventional ski manufacturing, the flex characteristics of a ski are determined in the design and manufacturing process, and therefore not changeable once the ski has been built. A ski with flex characteristics that may be changeable is desirable, however, so that a single pair of skis may be well-suited to different uses. To that end, skis with adjustable flex characteristics are known, with mechanical adjustment means (in tension, compression, or torsion) used to change the flex of a ski. Examples include threaded rods imbedded in or placed on the top surface of a ski, with nuts turnable to selectively apply pre-load to the ski to alter the ski's flex. However, such adjustment is cumbersome, and further does not allow a ski to self-adapt different stiffnesses.

What is needed, therefore, is a ski that can self-adjust its stiffness and damping capabilities according to the impact (or load-rate) applied to the ski, making a single pair of skis suitable for a much wider range of uses than a ski with fixed stiffness and damping.

BRIEF SUMMARY OF THE INVENTION

The ski and snowboard design of this application uses non-Newtonian dilatant materials in the structure of the ski. Non-Newtonian materials exhibit rate-sensitive, shear-thickening characteristics, with stress vs. strain properties dependent on the rate of loading. Thus, the material exhibits a greater resistance to force given a greater rate of loading, or impact.

The use of non-Newtonian materials results in a ski that has a variable stiffness/damping, with the stiffness/damping increasing according to an increased applied load-rate. This yields a single (pair of) skis that exhibit soft flex characteristics under lower applied load-rates, but stiffer flex characteristics under higher applied load-rates. This contrasts with existing skis, which exhibit the same flex regardless of load-rates applied. The non-Newtonian material may be incorporated into the laminated structure of the ski in any number of different ways.

DETAILED DESCRIPTION OF THE INVENTION

Described herein is a device for sliding on snow, particularly skis or snowboards. The preferred embodiment described is a ski, but the system may also be used in a snowboard. Similarly, the preferred embodiment are skis as attached to a human body—however the system may also be used in skis on vehicles such as snowmobiles, rescue sleds, etc.

Figure 1:
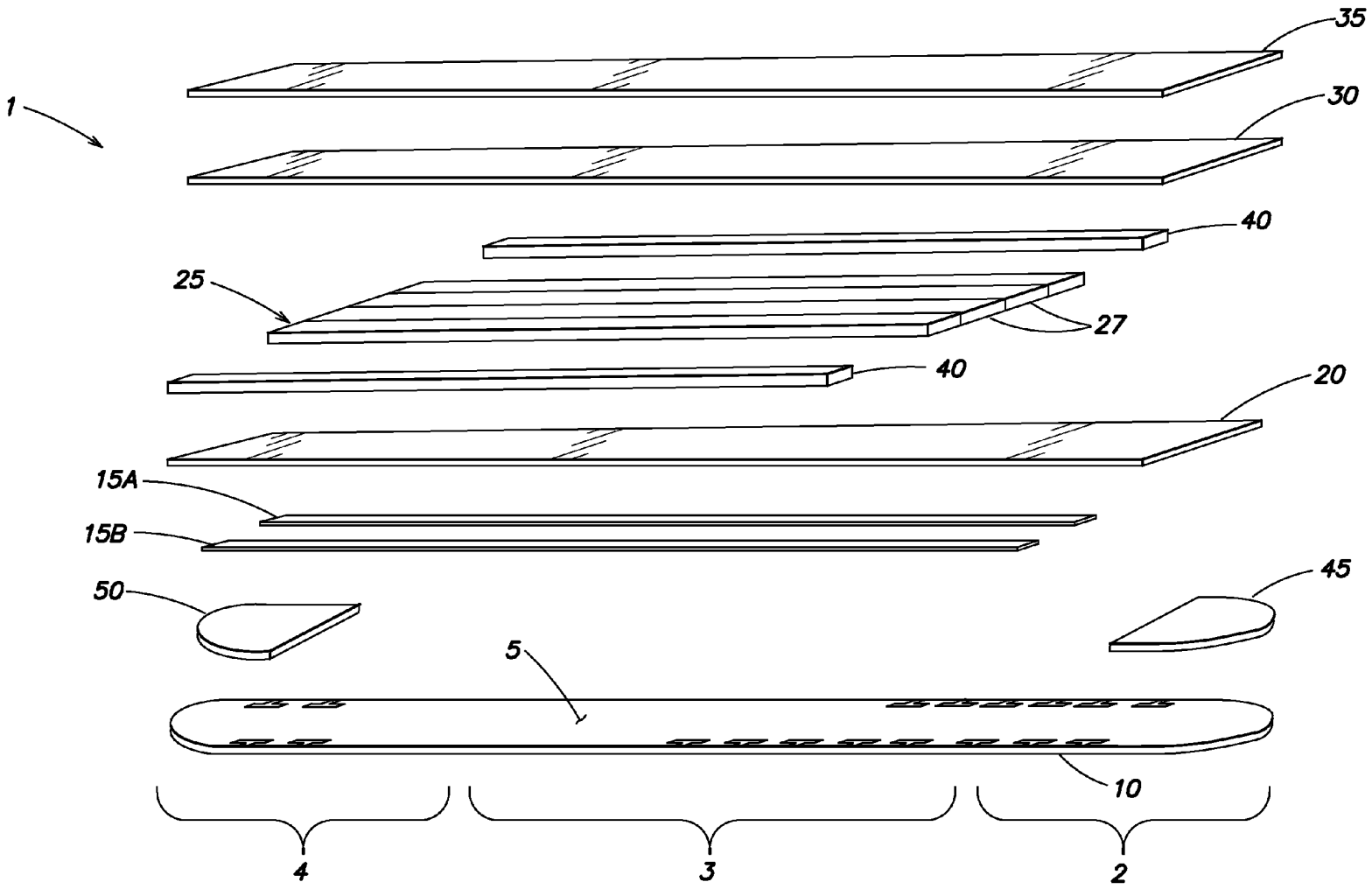
FIG. 1 shows an exploded perspective view of a ski

FIG. 1 shows an exploded view of general ski construction, with multiple layers laminated together to form the familiar elongated structure shape. As previously described, a ski 1 can be considered in three sections: the tip 2, located at the front of the ski; the midsection 3, located around the binding; and the tail 4, located at the opposite end from the tip. The lengths of each section are not necessarily equal to one another.

The lowermost layer, which provides the ski's primary snow-contact surface, is base 5, which is typically made of polyethylene plastic. A metal edge 10 runs longitudinally on the edge of base 5. The next layer in the lamination is rubber strips 15*a* and 15*b*, which serve to smooth shear forces between edge 10 and other parts of the lamination structure. Next is a sheet layer 20, typically made of a composite material such as but not limited to fiberglass, carbon fiber, Kevlar, Cordura, nylon or similar material. Metals such as but not limited to titanium and aluminum may also be used as sheet layer 20.

In existing skis, core 25 is typically made of wood, foam, and/or a type of honeycomb composite. For a wood core, one or more core strips 27 of wood are typically laminated together on edge, to form a core with the initial desired width and thickness. The core is then shaped to the final desired size with regard to sidecut (the curavature, or shape of the ski as viewed from above) and thickness, typically with the use of a CNC cutting/milling device. That is, the width of the midsection, tip, and tail may all be different, to form the familiar hourglass shape or traditional straight sidecut of a ski. The thickness of core 25 may also vary over its longitudinal length, with core 25 typically thickest through the midsection, tapering to thinner at the tip and at the tail.

One or more additional sheet layer (s) 30, typically made of a composite material such as fiberglass, carbon fiber, Kevlar, Cordura, nylon or similar material, forms the next layer. A top sheet 35 is typically made of plastic, on to which graphic images and brand logos may be printed. Top layer 35 may alternately be transparent or translucent, allowing a lower layer of the ski lamination to be seen.

Sidewalls 40 form the approximately vertical sides of the elongated ski structure. Sidewalls 40 are typically made of plastic such as ABS or UHMW (Ultra High Molecular Weight), and serve to seal and protect the laminated structure of the ski. Sidewalls 40 typically span the vertical space between metal edge 10 and top sheet 35. Sidewalls 40 may also serve as a component that contributes to the stiffness of the ski, particular torsional stiffness, as will be detailed further. An alternate construction know in the art, not shown, eliminates sidewalls 40 by wrapping sheet layer 30 and top sheet 35 down over the side of the laminated structure to reach metal edge 10. This is commonly known as 'Cap Construction' in the art. A combination of both traditional sidewalls (such as ABS or UHMW) and Cap Construction can be used.

Tip spacer 45 and tail spacer 50 serve as end pieces in the lamination, acting as transitional spacers between core 25 and the ends of the ski. Spacers 45 and 50 may be made from materials including: metal such as aluminum; plastic; wood; or composites.

The various layers and components described above are typically laminated together using epoxy resin, with a film of epoxy between each layer, though other methods of bonding can be used. The laminating process is typically done under pressure (such as from a press) to insure good bonding between layers to any eliminate or minimize any voids in the structure. After curing, any excess structure material is typically trimmed. In the preferred embodiment, two skis may be manufactured as one co-joined unit, helping insure that laminations, materials, etc. are as close to identical as possible between the two skis. Typically, the co-joined unit is then separated into two individual skis as part of the final trimming process.

This layup process may be altered (ex. 3D profiling of core), re-ordered (ex. both layers of composite material, 20 or 30, on one plane) and additional layers added (ex. addition layer of metal) to aid in manufacturability or change desired ski performance.

As previously described, a major determinant of the performance of a ski is its stiffness/damping, or flex, characteristics. This includes the planar stiffness across the length of the ski—that is, a ski considered in three-point bending, with a downward applied force through the midsection, and opposing upward forces from the snow. In practice, the loads are of course distributed and not point loads. Torsional stiffness of the ski from tip to tail also determines a ski's performance.

The vibration damping properties of a ski also determine a ski's performance. The forces acting on a ski cause the ski to flex and vibrate, particularly when skiing at high speeds. For example the oscillation periodically lessens the contact force and area—in some cases eliminates contact—between the ski edge and snow, resulting in reduced stability and control of the ski, and typically resulting in decreased speed. The materials used in a ski's construction, including the size, weight, and other mechanical and physical properties of the materials, determine the vibration characteristics of a ski. This includes the resulting damping characteristics that a ski exhibits in relation to vibration.

The use of Non-Newtonian materials ("NNM") in a ski results in improved stiffness, vibration and damping characteristics, compared to conventional materials and resulting skis previously known. NNM's exhibit rate-sensitive characteristics, with stress vs. strain properties dependent on the rate of loading. Thus, NNMs exhibit a greater resistance to force given a greater rate of loading, or impact. Further detailing NNMs, in a Newtonian fluid, the relation between the shear stress and the shear rate is linear, the constant of proportionality being the coefficient of viscosity. In an NNM, the relation between the shear stress and the shear rate is non-linear, and may be time-dependent. Therefore, for non-Newtonian fluids a constant coefficient of viscosity cannot be defined.

NNMs have traditionally been fluids; however, D30, a UK-based company, has produced different proprietary polymer materials that are also NNMs, providing rate-sensitive stress-strain characteristics. These NNMs are produced in the form of gel-like, foam-like and plastic-like polymers or similar. There are additional other forms, such as coatings that may be applied to substrates such as Cordura® and similar fabrics, which result in non-liquid materials that have non-Newtonian properties. Of course, any appropriate NNMs from any supplier may be used in the present system, including types which may be developed in the future.

The use of NNMs in the laminated structure of a ski results in a ski that has a stiffness/damping that varies according to the load rate applied to the ski when in use, where the stiffness/damping increases according to an increased applied load-rate. This yields a single (pair of) skis that exhibit soft flex characteristics under low applied load-rates, but stiffer flex characteristics under high applied load-rates. This contrasts with existing skis, which exhibit the same flex and damping characteristics regardless of load-rates applied.

The NNMs may be incorporated into the laminated structure of a ski in a number of different ways, where the NNM is present in at least one layer of the lamination.

Figure 2:
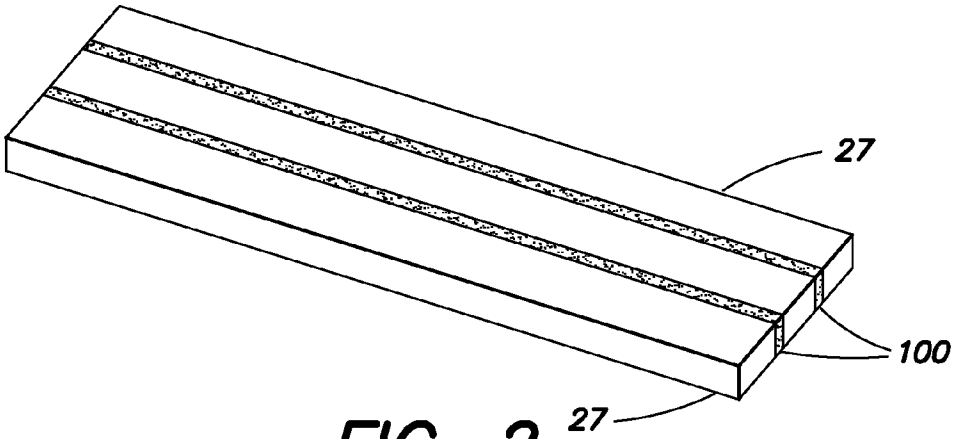
FIG. 2 shows a perspective view of laminated ski core using non-Newtonian material
Figure 3:
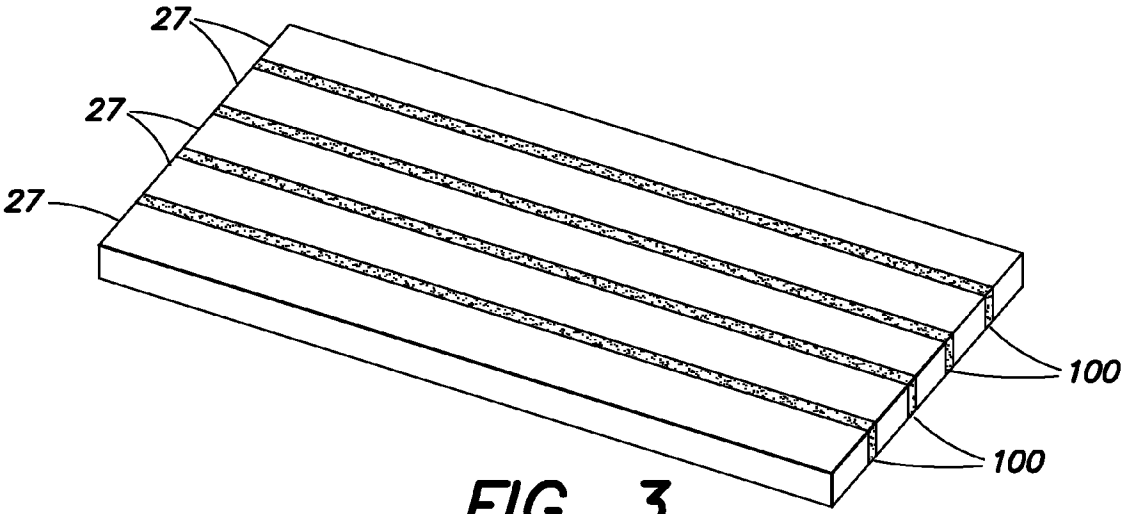
FIG. 3 shows a perspective view of laminated ski core using non-Newtonian material

As shown in FIG. 2, NNM may be incorporated as a strip 100 in at least a portion of the length of core 25, taking the place of one or more core strips 27. As shown, core 25 includes two strip 100 pieces. FIG. 3 shows four pieces of strip 100 as part of core 25. Any reasonable number of pieces of strip 100 may be incorporated into core 25 to achieve the overall stiffness and flex characteristics desired for the ski. Strip 100 may span the entire length of core 25, or only a portion of the entire length, with conventional core material used in places where the NNM is not located. The portion of the core that the NNM spans may be continuous, or the NNM may be in two or more discontinuous sections.

Figure 4:
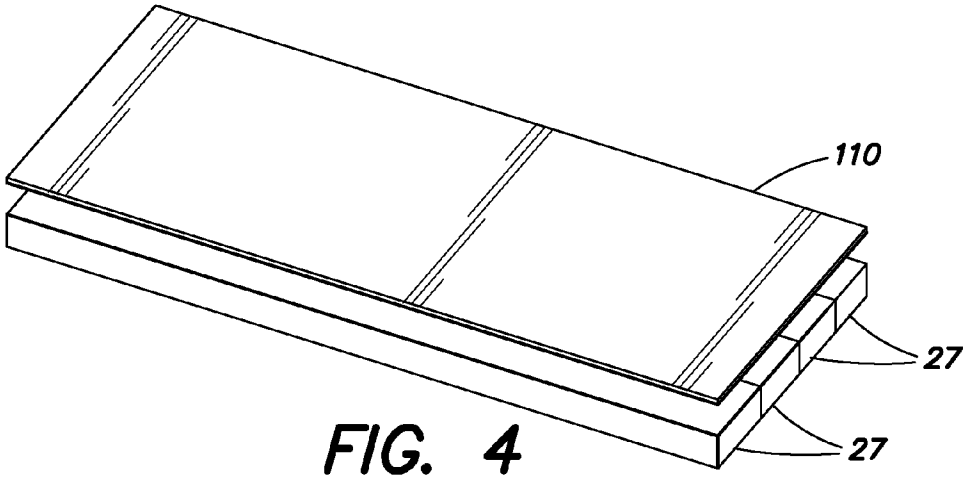
FIG. 4 shows a perspective view of a ski core and a sheet layer of non-Newtonian material

As shown in FIG. 4, NNM may be incorporated as a sheet layer 110. The sheet layer with NNM may take the place of sheet layer 30 as shown or sheet layer 20. Alternately, sheet layer 110 may be included in addition to sheets layer 20 and 30. Sheet layer 110 may span the entire length of the laminated assembly, or only a portion of the entire length. The portion of the length that sheet layer 110 spans may be continuous, or may be in two or more discontinuous sections.

Figure 5:
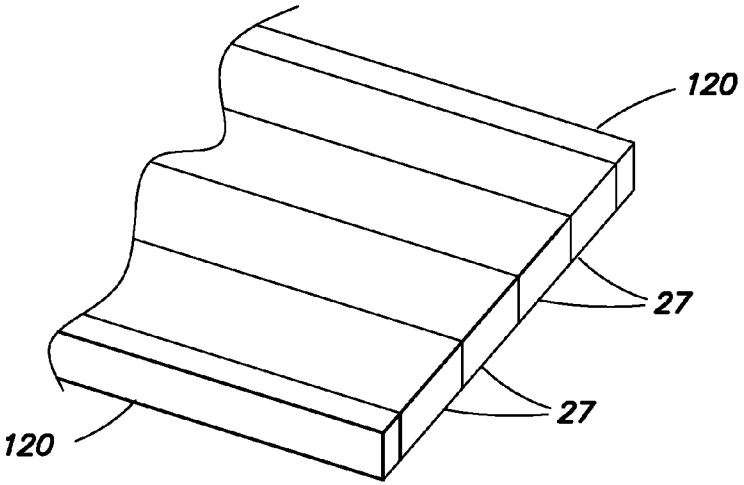
FIG. 5 shows a perspective view of a ski core and sidewalls made of non-Newtonian material

As shown in FIG. 5, NNM may be incorporated as a sidewall 120. NNM may be attached to the sidewall via lamination, or the NNM may be in a form of a coating on a conventional plastic sidewall, or NNM may be incorporated into part of the sidewall, or the sidewall itself may be constructed of NNM. The NNM may span the entire length of one or both sidewalls, or may be in two or more discontinuous sections.

Figure 6:
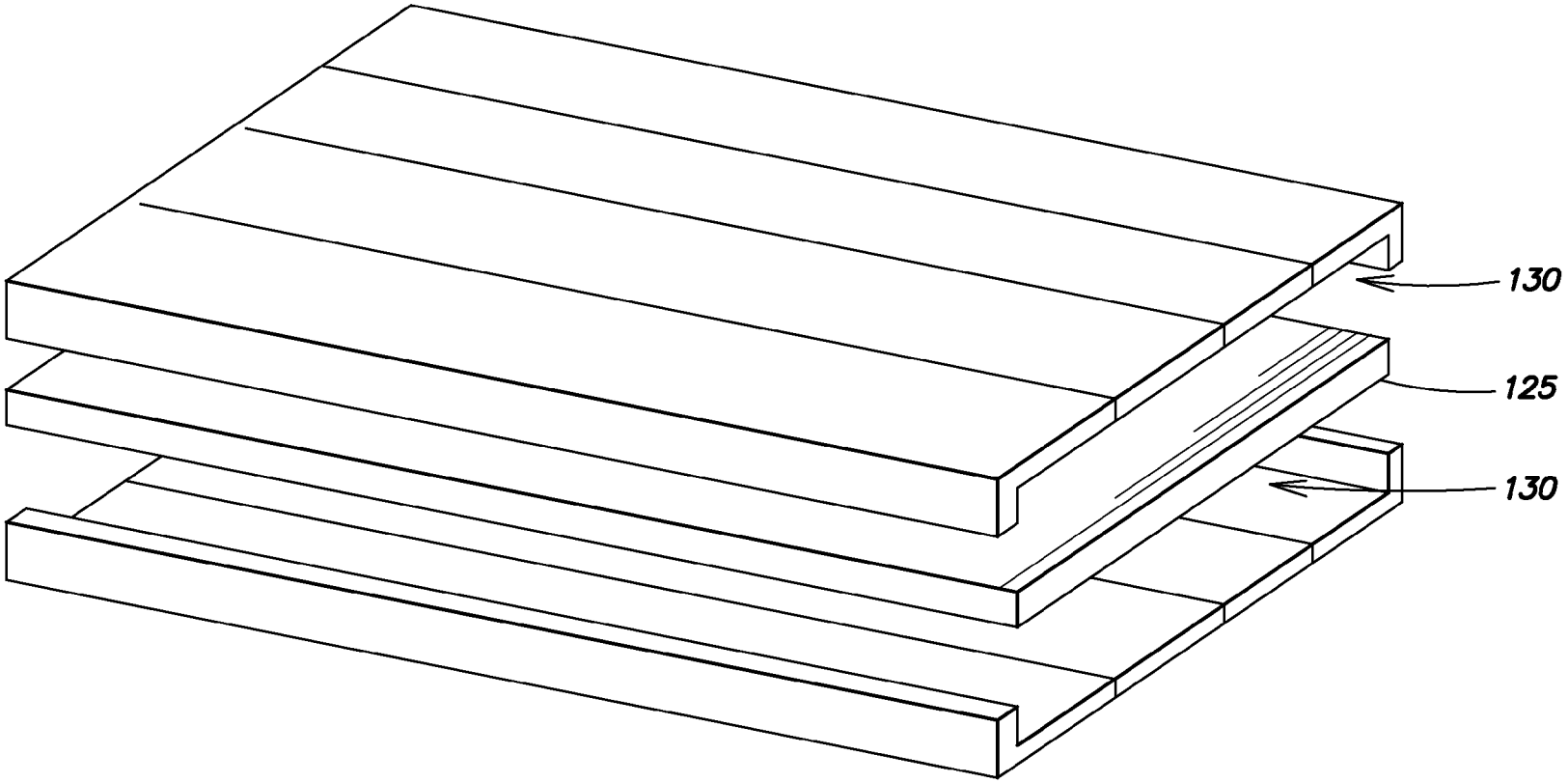
FIG. 6 shows a perspective view of non-Newtonian material incorporated into a hollow in a ski core
Figure 7:
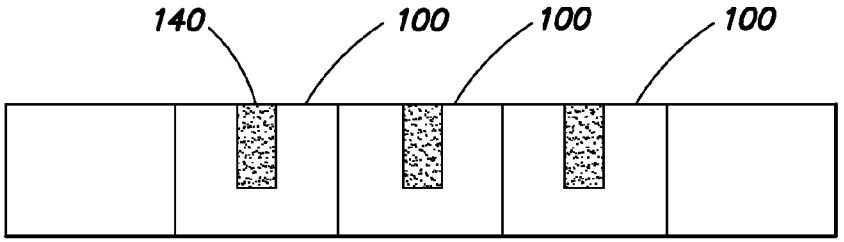
FIG. 7 shows a cross section of non-Newtonian material incorporated into multiple channels in a ski core
Figure 8:
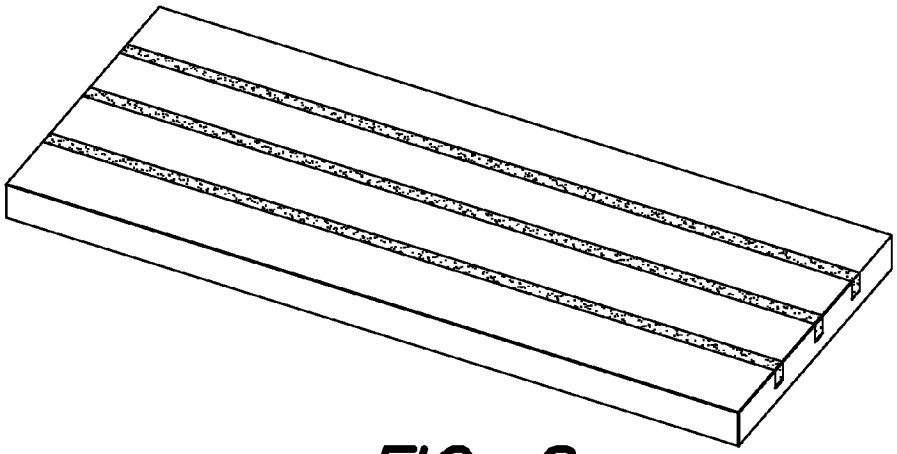
FIG. 8 shows a perspective view of non-Newtonian material incorporated into multiple channels in a ski core

As shown in FIG. 6, strip 125 made of NNM may be incorporated into a hollow 130 in at least a portion of the length of core 25. Hollow 130, and the NNM placed in it, may span the entire length of core 25, or only a portion of the entire length, with conventional wood used in places where the NNM is not located. The portion of the core that the NNM spans may be continuous, or the NNM may be in two or more discontinuous sections. FIG. 7 shows a similar arrangement, where the placement of the NNM in core 25 is in a channel 140, where there are a total of five pieces of strip 100, where three of the strips have channels filled with NNM material. Alternately, core 25 may be made of a single piece rather than composed of multiple strip 100 pieces, with a single channel for NNM material. Any number of strips of core 25 or number of NNM channels may be used. Alternately, the entire core may be constructed of NNM.

NNM may also be incorporated into tip spacer 45 and/or tail spacer hollow 50. Similar to other use of NNM in the laminated structure, the NNM may be coated on existing spacers, or a polymer-type spacer directly incorporating the NNM may be used.

Figure 9:
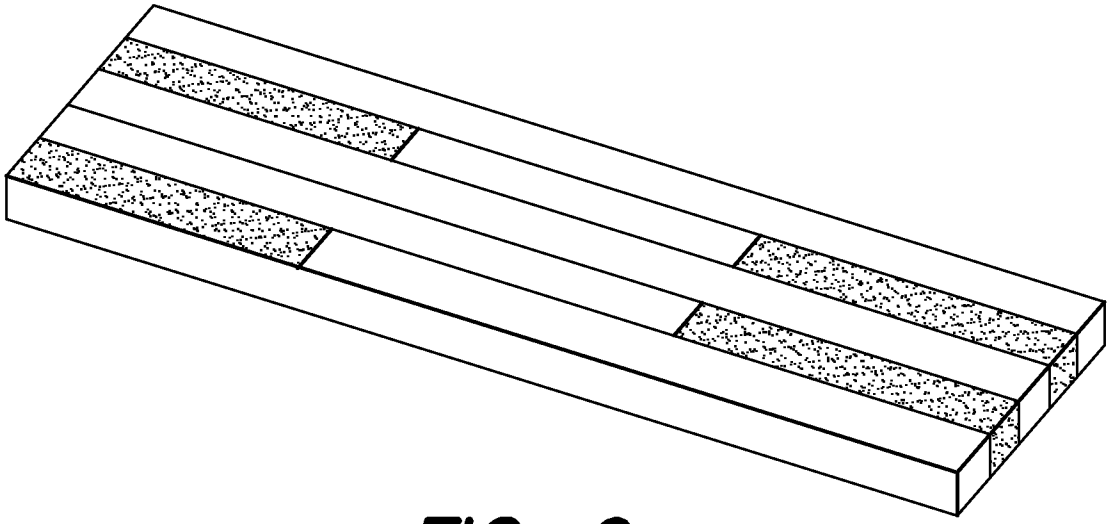
FIG. 9 shows a perspective view of non-Newtonian material in discontinuous sections as part of ski a core

Any of the described incorporation of NNM may in used alone as described, in any combination with each other. FIG. 9 shows four discontinuous sections of NNM as part of a core 25. This is one example of incorporating NNM into at least one portion of strip 100. In the same discontinuous manner, NNM may be incorporated into at least one portion of a sidewall 120, a core 25, a sheet layer 110, etc. The locations described within the laminated ski structure for NNM are examples, and other locations may be used as well, particularly for a structure that may differ from the typical structure described.

Although the present invention has been described with respect to one or more embodiments, it will be understood that other embodiments of the present invention may be made without departing from the spirit and scope of the present invention. Hence, the present invention is deemed limited only by the appended claims and the reasonable interpretation thereof.

What is claimed:

1. A device for sliding on snow, comprising:

an elongated structure made of multiple layers laminated together including at least a base layer and a metal edge running longitudinally on the edge of the base, rubber strips configured to smooth shear forces, a sheet layer, a core, a topsheet, an additional sheet layer, and sidewalls, wherein the sidewalls are located on each side of the device for sliding on snow between the metal edge and the topsheet; with a tip section, a mid section, and a tail section, and with a non-Newtonian material incorporated into at least one said layer of said structure.

2. The device as in claim 1, in which said non-Newtonian material is incorporated as at least one strip in at least a portion of a core's length.

3. The device as in claim 1, in which said non-Newtonian material is incorporated into at least a portion of at least one sidewall's length.

4. The device as in claim 1, in which said non-Newtonian material is incorporated into at least a portion of least one sheet layer.

5. The device as in claim 1 in which said non-Newtonian material is incorporated into a channel in a core, said channel spanning at least a portion of said core's length.

6. The device as in claim 1, in which said non-Newtonian material is incorporated into a hollow in a core, said hollow spanning at least a portion of said core's length.

7. The device as in claim 1, in which said non-Newtonian material is incorporated into a tip spacer.

8. The device as in claim 1, in which said non-Newtonian material is incorporated into a tail spacer.

9. The device of claim 1, in which said non-Newtonian material creates device stiffness and damping that varies according to a load rate applied to said device when in use.

10. A method of making a snow sliding device, comprising: laminating multiple layers together together including at least a base layer and a metal edge running longitudinally on the edge of the base, rubber strips configured to smooth shear forces, a sheet layer, a core, a topsheet, an additional sheet layer, and sidewalls, wherein the sidewalls are located on each side of the device for sliding on snow between the metal edge and the topsheet; into an elongated structure, said structure including a midsection, a tip section, and a tail sections; incorporating a non-Newtonian material in at least one said layer of said structure.

11. The method as in claim 10, using said non-Newtonian material as at least one strip in at least a portion of a core's length.

12. The method as in claim 10, using said non-Newtonian material as at least a portion of at least one sidewall's length.

13. The method as in claim 10, using said non-Newtonian material as at least a portion of least one sheet layer.

14. The method as in claim 10, using said non-Newtonian material as a channel in a core, said channel spanning at least a portion of said core's length.

15. The method as in claim 10, using said non-Newtonian material as a hollow in a core, said hollow spanning at least a portion of said core's length.

16. The method as in claim 10, using said non-Newtonian material as a tip spacer.

17. The method as in claim 10, using said non-Newtonian material as a tail spacer.

18. the method as in claim 10, with said non-Newtonian material creating device stiffness and damping that varies according to a load rate applied to said device when in use.

* * * * *